United States Patent [19]

Hornung et al.

[11] Patent Number: 4,666,516

[45] Date of Patent: May 19, 1987

[54] GRAY CAST IRON INOCULANT

[75] Inventors: Mary J. Hornung, N. Tonawanda; Edward C. Sauer, Williamsville, both of N.Y.

[73] Assignee: Elkem Metals Company, Pittsburgh, Pa.

[21] Appl. No.: 821,091

[22] Filed: Jan. 21, 1986

[51] Int. Cl.[4] ..... C22C 33/08

[52] U.S. Cl. ..... 420/30; 420/578; 420/590

[58] Field of Search ..... 75/130 R, 123 L; 420/578, 590

[56] References Cited

U.S. PATENT DOCUMENTS

| | | | |
|---|---|---|---|
| 2,036,576 | 4/1936 | Hardy | 75/133 |
| 2,154,613 | 4/1939 | Guthrie | 75/129 |
| 2,221,781 | 11/1940 | Critchett et al. | 75/58 |
| 2,221,783 | 11/1940 | Critchett et al. | 75/58 |
| 2,280,283 | 4/1942 | Crafts | 75/123 |
| 2,444,354 | 6/1948 | Kinnear | 75/130 |
| 2,494,238 | 1/1950 | Griggs et al. | 75/53 |
| 2,610,911 | 9/1952 | Udy | 75/27 |
| 2,676,097 | 4/1954 | Strauss | 75/122 |
| 2,750,284 | 6/1956 | Ihrig | 75/130 R |
| 2,805,150 | 9/1957 | Strauss | 75/130 R |
| 2,821,473 | 1/1958 | Moore | 75/130 |
| 2,932,567 | 4/1960 | Evans | 75/123 |
| 3,333,954 | 8/1967 | Dawson | 75/130 R |
| 3,374,086 | 3/1968 | Goehring | 75/130 R |
| 3,527,597 | 9/1970 | Dawson | 75/58 |
| 4,017,310 | 4/1977 | Downing | 75/130 R |

OTHER PUBLICATIONS

"Inoculation—Sulfur Relationship in Cast Iron"—K. M. Mazumdar, Grad. Student and J. F. Wallace, Prof. Met. Case Western Reserve University.

"Gray Iron Consistency and Response to Inoculation" Southern Research Institute—A Report to Newnam Foundry Division of Chromalloy Metal Tectonics.

"Gray Iron Inoculation and Inoculants Evaluation" W. C. Filkins, W. F. Stuhre, David Matter, J. F. Wallace.

"Nucleation of Eutectic Graphite in Inoculated Gray Iron by Saltlike Carbides"—B. Lux—Scientific Collaborator, Messrs. Sulzer Bros., Winterthur and Battelle Memorial Institute.

"Inoculation Effect of Graphite Formation in Pure Fe-C and Fe-C-Si"—Lux and H. Tannenberger.

"Factors Influencing the Inoculation of Cast Iron"—J. V. Dawson.

"Inoculation of Cast Iron" H. L. Morgan.

*Primary Examiner*—Peter D. Rosenberg

*Attorney, Agent, or Firm*—Lucas & Just

[57] ABSTRACT

A ferrosilicon inoculant for gray cast iron containing between 0.1 to 10% strontium, less than 0.35% calcium and either 0.1 to 15% zirconium, 0.1 to 20% titanium or a mixture of both zirconium and titanium with the strontium. The inoculant, method for producing the inoculant, method for inoculating the melt and a gray cast iron inoculated with the inoculant are covered.

14 Claims, No Drawings

GRAY CAST IRON INOCULANT

This invention relates to the manufacture of cast iron and more particularly to an inoculant for gray cast iron to improve the overall properties thereof.

Cast iron is typically produced in a cupola or induction furnace, and generally has about 2 to 4 percent carbon. The carbon is intimately mixed in with the iron and the form which the carbon takes in the solidified cast iron is very important to the characteristics of the cast iron. If the carbon takes the form of iron carbide, then the cast iron is referred to as white cast iron and has the physical characteristics of being hard and brittle which in certain applications is undesirable. If the carbon takes the form of graphite, the cast iron is soft and machinable and is referred to as gray cast iron.

Graphite may occur in cast iron in the flake, vermicular, nodular or spherical forms and variations thereof. The nodular or spherical form produces the highest strength and most ductile form of cast iron.

The form that the graphite takes as well as the amount of graphite versus iron carbide, can be controlled with certain additives that promote the formation of graphite during the solidification of cast iron. These additives are referred to as inoculants and their addition to the cast iron as inoculation. In casting iron products from cast iron, the foundryman is continually plagued by the formation of iron carbides in thin sections of the cast. The formation of the iron carbide is brought about by the rapid cooling of the thin sections as compared to the slower cooling of the thicker sections of the cast. The formation of iron carbide in a cast iron product is referred to in the trade as "chill". The formation of chill is quantified by measuring "chill depth" and the power of an inoculant to prevent chill and reduce chill depth is a convenient way in which to measure and compare the power of inoculants.

There is a constant need to find inoculants which reduce chill depth and improve the machinability of gray cast iron.

Since the exact chemistry and mechanism of inoculation and why inoculants function as they do is not completely understood, a great deal of research goes into providing the industry with a new inoculant.

It is thought that calcium and certain other elements suppress the formation of iron carbide and promote the formation of graphite. A majority of inoculants contain calcium. The addition of these iron carbide suppressants is usually facilitated by the addition of a ferrosilicon alloy and probably the most widely used ferrosilicon alloys are the high silicon alloy containing 75 to 80% silicon and the low silicon alloy containing 45 to 50% silicon.

U.S. Pat. No. 3,527,597 discovered that good inoculating power is obtained with the addition of between about 0.1 to 10% strontium to a silicon-bearing inoculant which contains less than about 0.35% calcium and up to 5% aluminum. U.S. Pat. No. 3,527,597 is incorporated herein by reference.

It has now been discovered that the addition of zirconium to a silicon-bearing inoculant containing strontium increases the efficiency of the inoculant. This was truly surprising and unexpected because a silicon-bearing inoculant containing zirconium does not produce as good a result as the strontium-containing silicon-bearing inoculant. Thus, to obtain improved results by the addition of zirconium to a silicon-bearing inoculant containing strontium is truly synergistic.

It has also been discovered quite unexpectedly that the addition of titanium to a silicon-bearing inoculant containing strontium also increases the efficiency of the inoculant. This is surprising because a silicon-bearing inoculant containing titanium is less efficient than a silicon-bearing inoculant containing strontium. Thus, the addition of titanium to a silicon-bearing inoculant containing strontium would be expected to decrease the efficiency of the silicon-bearing inoculant containing strontium. It was truly unexpected and is synergistic that just the opposite occurs.

It has additionally been discovered that the addition of both zirconium and titanium to a silicon-bearing inoculant containing strontium increases the efficiency of the inoculant. This too is also synergistic because, as pointed out above, the silicon-bearing inoculant containing either zirconium or titanium alone is less efficient than the silicon-bearing inoculant containing strontium. Thus, to improve the efficiency of the silicon-bearing inoculant containing strontium with the addition of both zirconium and titanium was truly surprising and unexpected.

It has been found that the strontium content in the inoculant of the present invention should be between about 0.1 to 10%. Preferably the inoculant contains about 0.4 to 4% strontium and better results are obtained with a strontium content of between about 0.4 to 1%. A good commercial inoculant has about 1% strontium.

In accordance with the present invention, the amount of zirconium should be between about 0.1 to 15% and preferably between about 0.1 to 10%. Best results will be obtained with a zirconium content of about 0.5 to 2.5%.

Also, it has been discovered that in accordance with the present invention the amount of titanium should be about 0.1 to 20% and preferably about 0.3 to 10%. Best results are obtained when the titanium is about 0.3 to 2.5%.

When both zirconium and titanium are added to the silicon-bearing inoculant containing strontium, the amount of zirconium and titanium is the same as if only zirconium or only titanium were added. In other words, it is within the scope of the present invention that when both zirconium and titanium are present in a silicon-bearing inoculant containing strontium the amount of zirconium is between about 0.1 to 15% and the titanium is between about 0.1 to 20.0%. Preferably the inoculant of the present invention containing both zirconium and titanium has about 0.1 to 10% zirconium and about 0.3 to 10% titanium. Best mode of the present invention is with an inoculant containing about 0.5 to 2.5% zirconium and about 0.3 to 2.5% titanium. Thus, it is clearly within the scope of the present invention to have, for example, the level of zirconium at about 0.5% and titanium at about 15%. Use of greater amounts of strontium, zirconium or titanium than those specified herein is of no particular advantage and only serves to increase cost of the inoculant and may lead to casting defects caused by slag inclusions promoted by excessive additions of reactive elements.

Also in accordance with the present invention, the calcium content must not exceed about 0.35% and preferably is below about 0.15%. Best results are obtained when the calcium content is below about 0.1%.

The inoculant can contain aluminum however it need not. When aluminum is present it should not exceed about 5%.

The amount of silicon in the inoculant can range between about 15% to 90% and preferably there is about 40% to 80% silicon in the inoculant.

The inoculant of the present invention can be made in any conventional manner with conventional raw materials. Generally, a molten bath of ferrosilicon is formed to which a strontium metal or strontium silicide is added along with a zirconium-rich material; titanium-rich material or both. Preferably, a submerged arc furnace is used to produce a molten bath of ferrosilicon. The calcium content of this bath is conventionally adjusted to drop the calcium content to below the 0.35% level. To this is added strontium metal or strontium silicide and a zirconium-rich material, a titanium-rich material or both. The additions of the strontium metal or strontium silicide, zirconium-rich material and the titanium-rich material to the melt is accomplished in any conventional manner. The melt is then cast and solidified in a conventional manner.

The solid inoculant is then crushed in a conventional manner to facilitate its addition to the cast iron melt. The size of the crushed inoculant will be determined by the method of inoculation, for example, inoculant crushed for use in ladle inoculation is larger than the inoculant crushed for use in mold inoculation. Acceptable results for ladle inoculation is found when the solid inoculant is crushed to a size of about ⅜ inch by down.

An alternative way to make the inoculant is to layer into a reaction vessel silicon, iron, strontium metal or strontium silicide and zirconium-rich material, titanium-rich material or both and then melt it to form a molten bath. The molten bath is then solidified and crushed as disclosed above.

The base alloy for the inoculant is preferably ferrosilicon which can be obtained in any conventional manner such as forming a melt of quartz and scrap iron in a conventional manner, however, it is also possible to use already formed ferrosilicon or silicon metal and iron. A copper-silicon alloy can also be used.

No matter whether a ferrosilicon or a copper-silicon alloy base is used for the inoculant the silicon content in the inoculant is about 15% to 90% and preferably about 40% to 80%. When the inoculant is made from a base alloy of ferrosilicon, the remaining percent or balance after all other elements is iron. When a copper-silicon alloy is used, it is preferable that not more than 30% copper be present in the inoculant. It is also possible that the inoculant could contain both copper and iron. When the inoculant contains both copper and iron, it is preferable that the inoculant contain not more than 30% copper.

Calcium will normally be present in the quartz, ferrosilicon and other additives such that the calcium content of the molten alloy will generally be greater than about 0.35%. Consequently, the calcium content of the alloy will have to be adjusted down so that the inoculant will have a calcium content within the specified range. This adjustment is done in a conventional manner.

The aluminum in the final alloy is also introduced into the alloy as an impurity in the various additives. If desired, it can also be added from any other conventional source of aluminum or aluminum can be refined out of the alloy using conventional technique.

The exact chemical form or structure of the strontium in the inoculant is not precisely known. It is believed that the strontium is present in the inoculant in the form of strontium silicide ($SrSi_2$) when the inoculant is made from a molten bath of the various constituents. However, it is believed that acceptable forms of strontium in the inoculant are strontium metal and strontium silicide no matter how the inoculant is formed.

Strontium metal is not easily extracted from its principal ores, Strontianite, strontium carbonate, ($SrCO_3$) and Celesite, strontium sulfate, ($SrSO_4$). It is not economically practical to use strontium metal during the production process of the inoculant and it is preferred that the inoculant is made with strontium ore.

U.S. Pat. No. 3,333,954 discloses a convenient method for making a silicon bearing inoculant containing acceptable forms of strontium wherein the source of strontium is strontium carbonate or strontium sulfate. The carbonate and sulfate are added to a molten bath of ferrosilicon. The addition of the sulfate is accomplished by the further addition of a flux. A carbonate of an alkali metal, sodium hydroxide and borax are disclosed as appropriate fluxes. The method of the '954 patent encompasses adding a strontium-rich material to a molten ferrosilicon low in calcium and aluminum contaminates at a sufficient temperature and for a sufficient period of time to cause the desired amount of strontium to enter the ferrosilicon. U.S. Pat. No. 3,333,954 is incorporated herein by reference and discloses a suitable way to prepare a silicon-bearing inoculant containing strontium to which either a zirconium-rich material, a titanium-rich material or both can be added to form the inoculant of the present invention. The addition of the zirconium-rich material, titanium-rich material or both can be accomplished by adding these materials to the molten bath of ferrosilicon either before, after or during the addition of the strontium-rich material. The addition of the zirconium-rich material, titanium-rich material or both is accomplished in any conventional manner.

It is known that strontium is a very volatile and reactive element and that generally only about 50% of the strontium added to the melt will show up in the inoculant. This must be taken into account when deciding on the amount of strontium desired in the inoculant.

The zirconium-rich material can come from any conventional source of zirconium, for example, zirconium silicon, zirconium metal and Zircaloy scrap.

The titanium-rich material can come from any conventional source of titanium.

There are the normal amount of trace elements or residual impurities in the finished inoculant. It is preferred that the amount of residual impurities be kept low in the inoculant.

In the specification and claims, the percent of the elements are weight percent based on the solidified final product inoculant unless otherwise specified.

It is preferred that the inoculant be formed from a molten mixture of the different constituents as described heretofore, however, some improvement in chill depth is experienced by making the inoculant of the present invention in the form of a dry mix or briquet that includes all of the constituents without forming a molten mix of the constituents. It is also possible to use two or three of the constituents in an alloy and then add the other constituents either in a dry form or as briquets to the molten iron bath to be treated. Thus, it is within the scope of this invention to form silicon-bearing inoculant containing strontium and use it with zirconium-rich material, a titanium-rich material, or a combination of the two.

The addition of the inoculant to the cast iron is accomplished in any conventional manner. Preferably the inoculant is added as close to final casting as possible. Typically, ladle and stream inoculation are used to obtain very good results. Mold inoculation may also be used. Stream inoculation is the addition of the inoculant to molten stream as it is going into the mold.

The amount of inoculant to add will vary and conventional procedures can be used to determine the amount of inoculant to add. Acceptable results have been found by adding about 5 to 6 pounds of inoculant per ton of cast iron when using ladle inoculation.

Although the discussion heretofore has dealt primarily with the addition of the inoculant of the present invention to cast iron to produce gray cast iron, it is likewise possible to add the inoculant of the present invention to a melt to reduce chill in ductile iron.

The following examples illustrate the present invention.

EXAMPLE 1

This example illustrates a method for making the inoculant of the present invention.

Into a 30 pound graphite crucible of an induction furnace silicon metal, strontium silicon, aluminum cubes and Armco iron are layered in along with either zirconium silicon, titanium metal or a mixture of both zirconium and titanium metal. All of the components are obtained from conventional sources. Armco iron is a conventional source of pure iron, generally 99% pure. A typical commercial analysis of Armco iron is:

TABLE I

| Component | Percent |
|---|---|
| Carbon | 0.03 |
| Manganese | 0.07 |
| Phosphorous | 0.006 |
| Sulfur | 0.008 |
| Iron | Balance |

By melting the composition under a partial argon cover and by keeping the bath temperature as low as possible oxidation losses are minimized. The resultant molten mix is then cast into graphite dishes and subsequently crushed, after solidification.

The amount of the various components in the inoculant must be monitored so that they fall within the scope of the teachings of the present invention. This is done in a conventional manner.

An acceptable inoculant in accordance with the present invention is thereby produced.

EXAMPLE 2

This example illustrates another method for making the inoculant of the present invention.

Into a submerged arc furnace, quartz, scrap iron, and a carbon source are reacted to produce a ferrosilicon in a conventional manner wherein the silicon content is within the range of 15 to 90% of the total weight of the melt. The calcium content of the ferrosilicon is adjusted to about 0.02% in a conventional manner. To this mixture strontium silicon and zirconium silicon, titanium metal or both are added to the melt. It is well-known that strontium is a very volatile and reactive element when added to liquid ferrosilicon and therefore the amount added will vary somewhat with the circumstances of the addition. Generally it is found that 50% of the strontium added to the ferrosilicon is retained in the inoculant. In any event, the strontium, zirconium, titanium and calcium content in the inoculant are in the ranges as previously mentioned, e.g. about 0.1 to 10%, about 0.1 to 15.0%, about 0.1 to 20.0% and less than about 0.35% respectively.

After the addition of the strontium and the zirconium, titanium or both, the alloy is solidified and crushed to $\frac{3}{8}$ inch×D for ladle inoculation. Solidification and crushing are accomplished in a conventional manner.

Suitable inoculants in accordance with the present invention are thus made.

EXAMPLE 3

This example illustrates inoculating cast iron with the silicon-bearing inoculant of the present invention containing both strontium and zirconium and the chill depths obtained thereby as compared to a commercial silicon-bearing inoculant containing strontium.

A molten bath of 100 pounds of conventional cast iron was prepared in a magnesia crucible of a 120 Kilowatt induction furnace. A graphite cover through which argon can flow at a rate of 10 cubic feet per hour is placed over the furnace. The argon provides a protective atmosphere and thus minimizes oxidation loss. Slag is removed from the top of the bath and the temperature raised to 1510° C. in preparation of tapping. An analysis of this molten bath showed the following typical results:

TABLE II

| Component | Weight Percent |
|---|---|
| Total carbon | 3.20 |
| Silicon | 2.10 |
| Sulfur | 0.10 |
| Phosphorous | 0.10 |
| Manganese | 0.80 |
| Titanium | 0.02 |
| Chromium | 0.02 |
| Iron | Balance |

Ladle inoculation is used to treat the cast iron. Clay-graphite No. 10 crucibles are preheated to 1025° C. in a gas fired furnace. The ladle is brought over to the induction furnace where a scale is used to measure out 6 kilograms of cast iron. The inoculant is added to the metal stream being tapped from the furnace into the ladle. A small heel of molten iron is usually allowed to accumulate on the bottom of the ladle before inoculation takes place. The inoculant is added during the remainder of the tap. The inoculant is added at 0.3% alloy addition which is equivalent to an addition of 6 lb./ton. The temperature of the treated metal is monitored with a thermocouple. As the metal cools, any slag that forms on its surface is removed.

When the metal in the crucible reached 1325° C. it was poured into 4C chill blocks. The averaging of the chill depth measurements from the 4C chill blocks provided the data for Table III below.

TABLE III

| Sample No. | % Zr | % Sr | Average Chill Depth (mm) |
|---|---|---|---|
| 1 | 0.12 | 0.72 | 2.3 |
| 2 | 0.14 | 0.79 | 4.8 |
| 3 | 0.24 | 0.83 | 2.0 |
| 4 | 0.25 | 0.82 | 4.6 |
| 5 | 0.58 | 0.86 | 3.0 |
| 6 | 0.72 | 0.73 | 4.6 |
| 7 | 0.93 | 0.94 | 1.9 |
| 8 | 0.95 | 0.60 | 5.4 |
| 9 | 1.00 | 0.83 | 1.6 |

TABLE III-continued

| Sample No. | % Zr | % Sr | Average Chill Depth (mm) |
|---|---|---|---|
| 10 | 1.32 | 0.80 | 3.5 |
| 11 | 1.53 | 0.84 | 2.4 |
| 12 | 1.54 | 0.75 | 3.6 |
| 13 | 1.70 | 0.75 | 2.4 |
| 14 | 2.00 | 0.75 | 4.7 |
| 15 | 1.90 | 0.64 | 2.8 |
| 16 | 2.22 | 0.91 | 1.7 |
| 17 | 2.28 | 0.60 | 3.3 |
| 18 | 3.15 | 0.81 | 2.0 |
| 19 | 3.10 | 0.88 | 4.6 |
| 20 | 5.69 | 0.95 | 2.7 |
| 21 | 11.54 | 0.97 | 4.9 |

Inoculants in accordance with the present invention were prepared with varying degrees of zirconium while the amount of strontium was held relatively constant. The method disclosed in the examples above was used to prepare these various inoculants. The percents of strontium and zirconium along with the resulting chill depth measurements of the inoculated gray cast iron are given in Table III above.

Typically each one of these inoculants had a chemical analysis in addition to what is shown above. The typical chemical analysis showed about 75% silicon, less than about 0.1% calcium, a maximum of about a half of a percent of aluminum, the balance of iron with an ordinary amount of residual impurities. The protocol for the chill depth measurements is detailed in ASTM A 367-60 (Reapproved 1972) 4th Ed. 1978. Method B was employed from the ASTM A 367-60 method. The sand cores were oil bonded and cured. A single core was used rather than a gang core. The chill plate was steel and was not water cooled. ASTM A 367-60 (Reapproved 1972) 4th Ed. 1978 is incorporated herein by reference. The chill depth was measured in accordance with the ASTM A 367-60 procedure.

Typically chill depths obtained using a commercial silicon-bearing inoculant containing strontium and sold under the name SUPERSEED by Elkem Metals Company has a chill depth of about 6.0 mm under identical test conditions as used herein. A typical chemical analysis of SUPERSEED is:

TABLE IV

| Component | Percent |
|---|---|
| Silicon | about 75 |
| Strontium | about 0.8 |
| Calcium | <0.1 |
| Aluminum | <0.5 |
| Iron | Balance |
| Residue impurities | Ordinary Amount |

Therefore, it is readily apparent that the inoculant of the present invention produces superior results to that of an inoculant containing only strontium.

EXAMPLE 4

This example illustrates inoculating cast iron with the silicon-bearing inoculant of the present invention containing both strontium and titanium and the improved chill depths obtained thereby.

A molten bath of iron was prepared as disclosed in Example 3. Inoculants were prepared in accordance with the present invention. This time, the percent of strontium was held relatively constant, and the amount of titanium was varied. Table V below illustrates the percent of strontium and titanium in each inoculant and the chill depths which resulted from the cast iron inoculated therewith. The chill bar preparation and chill depth measurements were identical to those disclosed in Example 3 above using a 4C chill bar.

TABLE V

| Sample No. | % Ti | % Sr | Average Chill Depth (mm) |
|---|---|---|---|
| 22 | 0.13 | 0.98 | 4.6 |
| 23 | 0.22 | 0.92 | 5.2 |
| 24 | 0.30 | 0.70 | 3.2 |
| 25 | 0.60 | 0.77 | 3.8 |
| 26 | 0.75 | 0.99 | 3.3 |
| 27 | 0.79 | 0.82 | 5.7 |
| 28 | 0.83 | 0.93 | 4.5 |
| 29 | 0.95 | 0.54 | 4.4 |
| 30 | 1.10 | 0.70 | 4.4 |
| 31 | 1.51 | 0.94 | 3.9 |
| 32 | 1.31 | 1.05 | 4.3 |
| 33 | 1.21 | 0.49 | 5.2 |
| 34 | 1.68 | 0.74 | 3.8 |
| 35 | 2.00 | 0.75 | 3.8 |
| 36 | 2.28 | 0.84 | 4.8 |
| 37 | 2.48 | 0.70 | 3.2 |
| 38 | 2.96 | 0.94 | 5.3 |
| 39 | 5.02 | 0.83 | 4.6 |
| 40 | 10.19 | 1.23 | 5.1 |
| 41 | 15.16 | 1.23 | 4.5 |

Typically each one of the inoculants had a typical chemical analysis of about 75% silicon, less than about 0.1% calcium, a maximum of about a half percent of a percent of aluminum, the balance of iron with the ordinary amount of residual impurities as well as the amount of strontium and titanium disclosed in Table V above.

It is readily apparent after a comparison with the commercial inoculant in Example 3, SUPERSEED, that the silicon-bearing inoculant of the present invention containing both strontium and titanium produces chill depths superior to that obtained with the commercial inoculant SUPERSEED which typically produces a chill depth of 6 mm under identical test conditions as used herein.

EXAMPLE 5

This example illustrates the synergistic effect obtained with the inoculants of the present invention. Inoculants were prepared in accordance with the present invention and conventional molten iron was inoculated therewith. 4C chill bars were made and chill depths measured thereafter. The results from these tests are as follows:

TABLE VI

| Sample No. | % Sr | % Zr | % Ti | Average Chill Depth (mm) |
|---|---|---|---|---|
| 42 | 0.64 | — | — | 6.2 |
| 43 | — | 1.95 | — | 12.7 |
| 44 | 0.76 | 1.70 | — | 2.4 |
| 45 | 0.84 | 1.53 | — | 2.4 |
| 46 | — | — | 1.00 | 11.2 |
| 47 | 0.77 | — | 0.60 | 3.9 |
| 48 | 0.74 | — | 1.68 | 3.8 |

Sample 42 was inoculated with SUPERSEED. Samples 43 and 46 were prepared in a manner identical to that disclosed in Example 1 except only zirconium or titanium was used. Typically, each one of the inoculants had beside the amount of strontium, zirconium and titanium disclosed above, a typical chemical analysis of about 75% silicon, less than about 0.1% calcium, a maximum of about one half of a percent aluminum, the balance iron and ordinary residual trace impurities.

It is clear from the data above that the results obtained from combining the strontium with zirconium or titanium is truly synergistic. An inoculant containing zirconium or titanium without strontium produces poorer results than an inoculant containing strontium, thus it is synergistic that the addition of zirconium or titanium to an inoculant containing strontium produces superior results to that of the strontium inoculant.

EXAMPLE 6

In this example a mixture of a commercial silicon-bearing inoculant containing strontium, SUPERSEED, and either metallic titanium or zirconium silicon was added to the molten melt of iron. The amount of zirconium silicon or titanium metal mixed with the commercial inoculant is shown in the table below.

TABLE VII

| Sample No. | Amount (grms) Titanium Metal | Amount (grms) Zirconium Silicon | Average Chill Depth (mm) |
|---|---|---|---|
| 49 | — | — | 6.2 |
| 50 | 2.70 | — | 5.5 |
| 51 | — | 0.54 | 5.0 |

Ladle inoculation was conducted and each of the various treated samples were tested for chill depth in accordance with ASTM 367-60 using 4C chill blocks as disclosed in Example 3 above. The commercial inoculant, Sample 49, was SUPERSEED.

It is readily apparent that although the zirconium and titanium are merely mixed with a commercial inoculant containing strontium that better results occur than without the zirconium and titanium.

EXAMPLE 7

This example illustrates a method for making the inoculant of the present invention as well as treating molten iron to make gray cast iron. A molten iron bath is treated with the inoculant of the present invention and compared to both an untreated cast iron and to cast iron treated with a commercial silicon-bearing inoculant containing strontium, SUPERSEED.

Into a 30 pound graphite crucible of an induction furnace is placed silicon metal, strontium silicon, aluminum cubes and Armco iron.

Added to the composition in the crucible was zirconium silicon. Oxidation losses were minimized by melting the components under a partial argon cover and by maintaining the bath temperature as low as possible. The alloys were cast into graphite dishes and subsequently crushed to $\frac{3}{8}$ inch×65 M. A portion of the crushed material was submitted for chemical analysis. The chemical composition of the inoculant of the present invention as made above and of the commercial silicon-bearing inoculant containing strontium are shown below:

TABLE VIII

| Percent Component | Present Invention | Commercial Inoculant |
|---|---|---|
| Silicon | 75.45 | 77.59 |
| Strontium | 0.84 | 0.64 |
| Calcium | 0.045 | 0.038 |
| Aluminum | 0.32 | 0.34 |
| Zirconium | 1.53 | — |
| Iron | Balance | Balance |

Both inoculants had residual impurities in the ordinary amounts.

Next, several iron melts were made by charging pig iron, Armco iron as disclosed above, silicon metal, electrolytic manganese, ferro-phosphorous and ferrosulfide into magnesium oxide crucibles. A 100 pound induction furnace was used to melt the components and was maintained under a partial argon cover to minimize oxidation losses. The base iron melts had the following typical chemical analysis:

TABLE IX

| Component | Percent |
|---|---|
| Total carbon | 3.20 |
| Silicon | 2.10 |
| Manganese | 0.80 |
| Phosphorous | 0.10 |
| Sulfur | 0.10 |
| Iron | Balance |
| Residual impurities | Normal |

The melts were stirred and the slag removed from the top. The temperature of the baths was then raised to 1510° C. in preparation for tapping. Various seven kilogram ladles of iron were tapped. The first ladle of each bath was not treated with an inoculant. Each of the remaining ladles were inoculated with a 0.30% alloy addition of the inoculants. 4C chill bars were made in accordance with ASTM 367-60 and the chill depths measured. The average results for the chill depths of the three samples are as follows:

TABLE X

| | Chill Depth (mm) |
|---|---|
| No inoculant | 14.8 |
| Inoculant of present invention | 2.4 |
| Commercial inoculant | 6.2 |

The commercial silicon-bearing inoculant containing strontium was obtained from Elkem Metals Co. and is sold under the trademark SUPERSEED.

It is readily apparent that the inoculants of the present invention produces far superior results to that of the conventional commercial inoculant or to the untreated sample.

It will be understood that the preferred embodiments of the present invention herein chosen for the purpose of illustration are intended to cover all changes and modifications of the preferred embodiments of the present invention which do not constitute a departure from the spirit and scope of the present invention.

What is claimed is:

1. A method for making an inoculant for cast iron comprising adding a strontium-rich material and a material rich in one or more additives selected from the group consisting of zirconium, titanium alone or in combination to a molten ferrosilicon low in calcium at a sufficient temperature and for a sufficient period of time to cause the desired amount of strontium to enter the ferrosilicon.

2. The method of claim 1 wherein the amount of strontium in the inoculant is about 0.1% to 10%; and the amount of calcium is less than about 0.35%.

3. The method of claim 2 wherein the amount of strontium in the inoculant is about 0.4% to 1%; the amount of zirconium is about 0.5% to 2.5%; the amount of titanium is about 0.3% to 2.5%; and the amount of calcium is less than about 0.1%.

4. A method for making a ferrosilicon inoculant for cast iron comprising combining strontium; less than about 0.35% calcium; one or more additives selected from the group consisting of zirconium and titanium alone or in combination, whereby said inoculant contains about 0.1 to 15% zirconium, about 0.1% to 20% titanium alone or in combination.

5. The method of claim 4 wherein the amount of strontium in the inoculant is about 0.1% to 10%.

6. A method for inoculating a cast iron melt comprising treating cast iron melt with an inoculant, said inoculant containing strontium; less than about 0.35% calcium; and one or more additives selected from the group consisting of zirconium; titanium alone or in combination.

7. The method of claim 6 wherein the inoculant is further characterized as having a strontium content of about 0.1 to 10%; a zirconium content of about 0.1 to 15%; and a titanium content of about 0.1 to 20%.

8. A gray cast iron having been inoculated with an inoculant comprising strontium; less than about 0.35% calcium; and one or more additives selected from the group consisting of zirconium, titanium alone or in combination.

9. The gray cast iron of claim 8 wherein the inoculant is further characterized as having the strontium content of about 0.1 to 10%; the zirconium content of about 0.1 to 15%; and the titanium content of about 0.1 to 20%.

10. The method of claim 1 wherein said strontium rich material is strontium sulfate and further comprising the step of adding a flux.

11. The method of claim 10 wherein said flux is selected from the group consisting of a carbonate of an alkali metal, sodium hydroxide and borax.

12. The method of claim 1 wherein said strontium rich material is strontium carbonate.

13. The method of claim 1 wherein said strontium rich material is selected from the group consisting of strontium metal and strontium silicide.

14. The method of claim 4 wherein said strontium is strontium metal or strontium silicide.

* * * * *